US006050502A

United States Patent [19]

Clark

[11] Patent Number: 6,050,502

[45] Date of Patent: Apr. 18, 2000

[54] ROTARY SPRINKLER WITH MEMORY ARC MECHANISM AND THROTTLING VALVE

[75] Inventor: Mike Clark, San Marcos, Calif.

[73] Assignee: Hunter Industries, Inc., San Marcos, Calif.

[21] Appl. No.: 09/198,911

[22] Filed: Nov. 24, 1998

[51] Int. Cl.[7] ..... B05B 3/04

[52] U.S. Cl. ..... 239/237; 239/206; 239/240; 239/DIG. 1

[58] Field of Search ..... 239/200–206, 239/240, 242, 237, 263.3, DIG. 1; 251/74

[56] References Cited

U.S. PATENT DOCUMENTS

| | | | |
|---|---|---|---|
| 3,107,056 | 10/1963 | Hunter | 239/205 |
| 4,568,024 | 2/1986 | Hunter | 239/242 |
| 4,624,412 | 11/1986 | Hunter | 239/232 |
| 4,625,914 | 12/1986 | Sexton et al. | 239/206 |
| 4,718,605 | 1/1988 | Hunter | 239/242 |
| 4,901,924 | 2/1990 | Kah, Jr. | 239/242 |
| 4,948,052 | 8/1990 | Hunter | 239/242 |
| 5,383,600 | 1/1995 | Verbera et al. | 239/205 |
| 5,762,270 | 6/1998 | Kearby et al. | 239/205 |

*Primary Examiner*—Andres Kashnikow
*Assistant Examiner*—Lisa Ann Douglas
*Attorney, Agent, or Firm*—Michael H. Jester

[57] ABSTRACT

A pop-up rotary sprinkler with adjustable arc limits has a memory arc mechanism separate from its arc adjustment and head reversing mechanisms for automatically returning the head to oscillation between its pre-set sector limits should its head be twisted or held against normal rotation by a vandal. The sprinkler may optionally include a throttling valve for substantially reducing the flow of water from the nozzle in the head until the head has rotated back within its pre-set arc limits. The amount of water that would otherwise be sprayed onto walkways and highways, for example, is greatly reduced, thereby eliminating safety hazards.

20 Claims, 12 Drawing Sheets

ROTARY SPRINKLER WITH MEMORY ARC MECHANISM AND THROTTLING VALVE

BACKGROUND OF THE INVENTION

The present invention relates to irrigation equipment, and more particularly, to rotor-type sprinklers that spray water over an adjustable arc.

Rotor-type sprinklers are widely used for watering lawns, golf courses, athletic fields and other landscaping. Typically such a sprinkler includes a cylindrical outer housing with a central riser that extends upwardly when the water is turned ON and retracts when the water is turned OFF. A head at the upper end of the riser includes a nozzle that directs a stream of water over the adjacent area. The head is rotated about a vertical axis by an internal turbine and gear drive through an predetermined arc whose ends limits are usually manually adjustable with a special tool. See for example, U.S. Pat. No. 3,107,056 granted Oct. 15, 1963 to Edwin J. Hunter and U.S. Pat. No. 4,568,024 granted Feb. 4, 1986 to Edwin J. Hunter.

Adjustable arc pop-up sprinklers typically have a reversing mechanism associated with the gear drive for the head. The direction of the water stream from the nozzle thus oscillates between pre-set end limits. These ends limits are usually trip points. For the sake of simplicity usually one end limit is fixed and the other end limit is moved along a circumferential ring or bull gear. Thus sector areas for watering can be pre-programmed such as forty-five degrees, seventy degrees, one hundred and eighty degrees, two hundred and seventy degrees, etc.

Adjustable arc sprinklers, like all sprinklers, are subject to vandalism. Frequently vandals will twist a riser of an oscillating pop-up sprinkler beyond its pre-set arc limits. Other times vandals will hold the riser against normal rotation by the internal drive. An adjustable pop-up sprinkler must therefore be constructed so it will not be permanently damaged if its riser is manually twisted or held against normal rotation, thereby forcing the head outside its pre-set arc limits. In addition, it is desirable to provide the adjustable arc sprinkler with the ability to automatically return its rotating head back to oscillation within the previously established end limits, otherwise an area that is not supposed to be watered receives water and visa versa.

U.S. Pat. Nos. 4,625,914 and 4,901,924 each disclose a sprinkler with a so-called "memory arc" mechanism that causes the head of the sprinkler to return to oscillation within preset arc limits after being twisted outside these limits by a vandal. However, in each case the memory arc mechanism is an integral part of the reversing mechanism for the head. If the memory arc mechanism fails even though a vandal has not forced the riser, the reversing mechanism can fail, such that the water stream does not move back and forth in the desired sector. In addition, after a vandal has twisted the riser so that its head is rotated outside the preset arc limits it can take as much as thirty seconds or more before the head of the sprinkler is returned to a position within its original arc limits. The amount of time varies depending upon the size of the pre-set arc, how far the riser has been twisted and the direction that the riser has been twisted. During this time, the full water stream is projected onto areas that are not supposed to receive water, such as walkways, roadways and the like, which can create safety hazards.

SUMMARY OF THE INVENTION

It is therefore the primary object of the present invention to provide an adjustable arc rotary sprinkler with a memory arc mechanism that is completely separate from the reversing mechanism.

It is another object of the present invention to provide an adjustable arc rotary sprinkler with memory arc that includes a mechanism for substantially reducing the flow of water from the nozzle when the head of the sprinkler is forced beyond its pre-set arc limits.

It is still another object of the present invention to provide an adjustable arc sprinkler with a mechanism for substantially reducing the flow of water from its nozzle when the stream is outside a pre-programmed arc.

According to one aspect of the present invention a sprinkler has a housing with an outlet end including a rotatable head with a nozzle for ejecting a stream of water. A water powered drive mechanism is mounted in the housing for driving the head about an axis. An arc adjustment mechanism is provided in the housing for pre-setting at least one of a pair of end limits of rotation of the head. A reversing mechanism reverses a direction of rotation of the head when a rotational position of the head reaches each of the end limits so that the stream of water will travel through a predefined angular sector. A memory arc mechanism separate from the reversing mechanism causes the head to return to rotation between the ends limits after the head has been forced outside the end limits. Optionally the sprinkler may further comprise a throttling valve mounted in the housing for automatically reducing the flow of water from the nozzle while the rotational position of the head is outside the end limits.

In accordance with another aspect of the present invention, a sprinkler has a housing with an outlet end and a head mounted at the outlet end. The head includes a nozzle for ejecting a stream of water. A passage extends through the housing for delivering water to the nozzle. A drive shaft is mounted in the housing for angular rotation about a vertical axis and a clutch assembly operatively couples the head and the drive shaft. A drive mechanism powered by water flowing through the housing rotates the drive shaft. An arc adjustment mechanism mounted in the housing permits pre-setting of at least one of two end limits of angular movement of the head. A reversing mechanism mounted in the housing reverses a direction of rotation of the head when the drive shaft reaches each of the end limits so that the stream of water will oscillate through a predetermined arc. The clutch assembly is configured to disengage the head and the drive shaft when the head is manually twisted or is held against rotation and to automatically engage the head and the drive shaft so that the stream of water will always return to oscillation within the predetermined arc. A throttling valve mechanism may also be mounted in the housing and is actuated by the clutch assembly. The throttling valve mechanism reduces the flow of water from the nozzle when the rotational position of the head is outside the pre-set end limits.

In accordance with still another aspect of the present invention an arc adjustable sprinkler is provided that will substantially reduce the flow of water from its nozzle when the nozzle is forced outside of its pre-programmed arc. The sprinkler has a housing with an outlet end and a nozzle mounted at the outlet end for ejecting a stream of water in an outward direction from the housing. A passage extends through the housing for delivering water to the nozzle. A drive mechanism is mounted in the housing and is coupled to the nozzle for rotating the nozzle about an axis. An arc adjustment mechanism is mounted in the housing for pre-setting at least one of two end limits of angular movement of the nozzle. A reversing mechanism is mounted in the housing that reverses a direction of rotation of the nozzle when a rotational position of the nozzle reaches each of the end limits so that normally the stream of water will oscillate through a predetermined arc. A throttling valve mechanism is mounted in the housing for automatically reducing the stream of water ejected from the nozzle when the rotational position of the nozzle is forced outside the end limits.

DESCRIPTION OF THE PREFERRED EMBODIMENT

Figure 1:
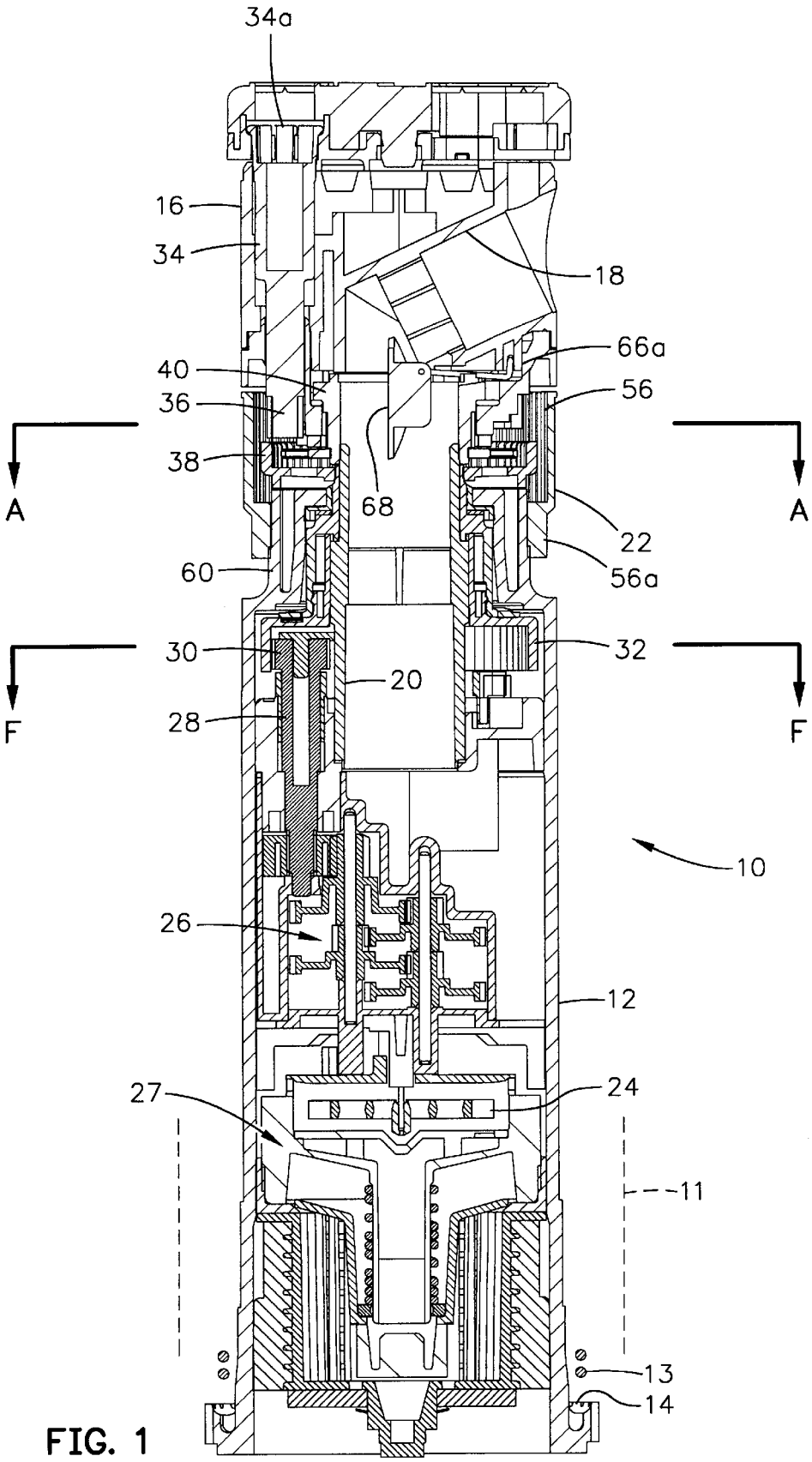
FIG. 1 is a vertical sectional view of a pop-up rotary sprinkler incorporating a preferred embodiment of the present invention.

Referring to FIG. 1, in accordance with the present invention a pop-up rotary sprinkler 10 has a cylindrical outer housing 11 shown diagrammatically as a pair of phantom lines. The outer housing 11 has a female threaded lower end (not illustrated) that screws over a male threaded fitting (not illustrated) connected to a pressurized water supply line (not illustrated). Unless otherwise indicated all parts of the sprinkler 10 are preferably made of injection molded plastic for economy, strength and durability. The sprinkler 10 includes a cylindrical inner housing or riser 12 mounted concentrically within the outer housing 11. The riser 12 extends upwardly from the outer housing 11 when the water pressure is turned ON. When the water is turned OFF, the riser 12 retracts within the outer housing 11 under the force of a metal coil retracting spring 13 shown diagrammatically in FIG. 1. The ends of the coil spring 13 captured between an upwardly opening retaining flange 14 at the lower end of the riser 12 and a shoulder (not illustrated) at the upper end of the outer housing 11.

The riser 12 (FIG. 1) has an upper outlet end including a rotating head 16 having a nozzle 18 for ejecting an inclined stream of water (not illustrated) over the landscaping to be watered. When the riser 12 is fully retracted, the upper end of the head 16 is flush with the upper end of the outer housing 11, which is in turn flush with the level of the ground in which the sprinkler 10 is installed in subterranean fashion.

The head 16 (FIG. 1) is releasably coupled to the upper end of a large centrally located hollow central drive shaft 20 by a clutch assembly 22. The clutch assembly 22 provides a memory arc mechanism as hereafter described in detail. The central drive shaft 20 defines a tubular vertical passage through which water is conveyed to the nozzle 18. A conventional water powered drive mechanism in the form of a water turbine 24 and a gear reduction 26 rotate the central drive shaft 20 about a vertical axis at a predetermined slow angular rate. The gear reduction 26 is made up of a plurality of intermeshing gears that rotate around parallel metal shafts. The rate of rotation of the central drive shaft 20 is kept substantially uniform by a conventional stator assembly 27 that operates as a pressure regulator to maintain rotor RPM within a narrow range despite fluctuations in water pressure. Other forms of water powered drive mechanism besides the turbine may be used, such as an impact drive.

The gear reduction 26 is coupled to the drive shaft 20 through an asymmetrically located vertical drive shaft 28 having a pinion gear 30 that engages a toothed inner surface of a bull gear 32. A conventional arc adjustment mechanism is provided for pre-setting one of a pair of adjustable end limits of rotation of the head 16. A conventional reversing mechanism causes rotation of the head 16 to reverse each time it reaches each of the pre-set end limits so that the stream of water will travel through a predefined angular sector. This causes the stream of water from the nozzle 18 to oscillate through a predetermined arc. The end limit and reversing mechanisms are physically associated with the bull gear 32.

Arc adjustment and reversal mechanisms for rotary sprinklers are well known in the irrigation sprinkler art. See for example, U.S. Pat. Nos. 3,107,056; 4,568,024; 4,624,412; 4,718,605 and 4,948,052 of Edwin J. Hunter, the entire disclosures of which are hereby incorporated by reference. Where the drive mechanism is the impulse type, the reversal mechanism may consist of a series of vents and ports with movable members for diverting water flow to reverse the direction of movement of the head, as disclosed in U.S. Pat. No. 4,625,914 previously mentioned above. In the sprinkler 10 of FIG. 1, one end limit of the arc is conveniently manually adjustable via an elongate cylindrical collet 34, the upper end 34*a* of which is accessible with a special tool through an opening in the top of the head 16. This allows a pinion gear 36 on the lower end of the collet 34 to engage the inwardly facing teeth of a spur gear 38 for setting one of the arc limits. The other arc limit is normally fixed although both arc limits could be adjustable.

The clutch assembly 22 couples the upper end of the central drive shaft 20 to the head 16. The clutch assembly 22 is configured to disengage the head 16 with the central drive shaft 20 when the head 16 is manually twisted or is held against rotation, e.g. by a vandal, to cause rotation of the head 16 to be forced to a first rotational position outside the end limits. Thereafter the clutch assembly 22 automatically engages and disengages the head 16 and the central drive shaft 20 to rotate the head 16, in stepped fashion, back to a second rotational position inside the end limits. The stream of water from the nozzle 18 will then once again oscillate through the predetermined arc.

Figure 2:
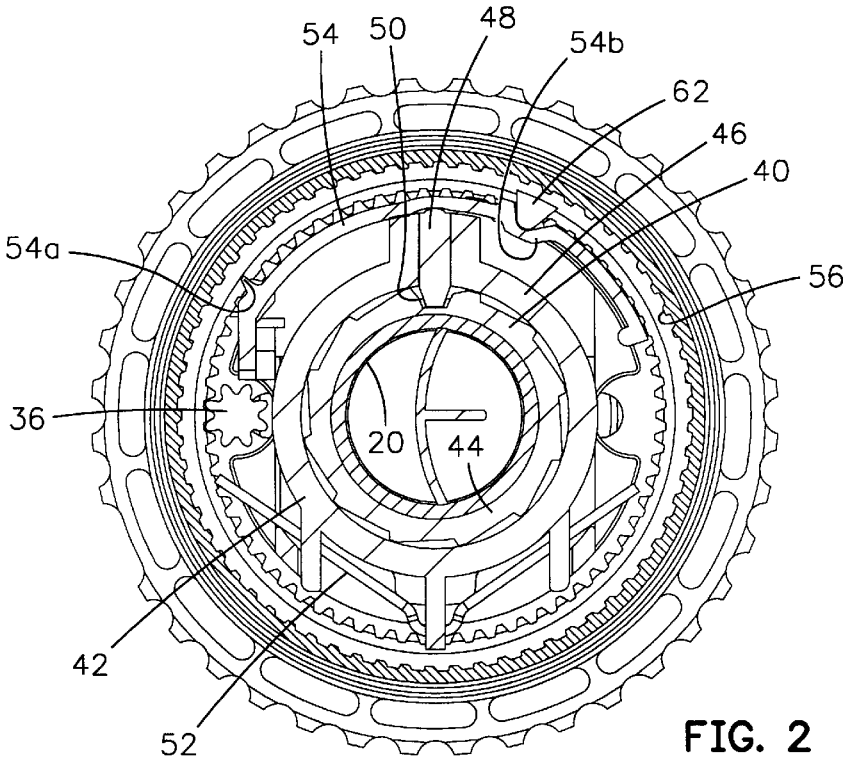
FIG. 2 is an enlarged cross-sectional view of the sprinkler taken along line A—A of FIG. 1 showing its throttling valve in its open position.
Figure 3:
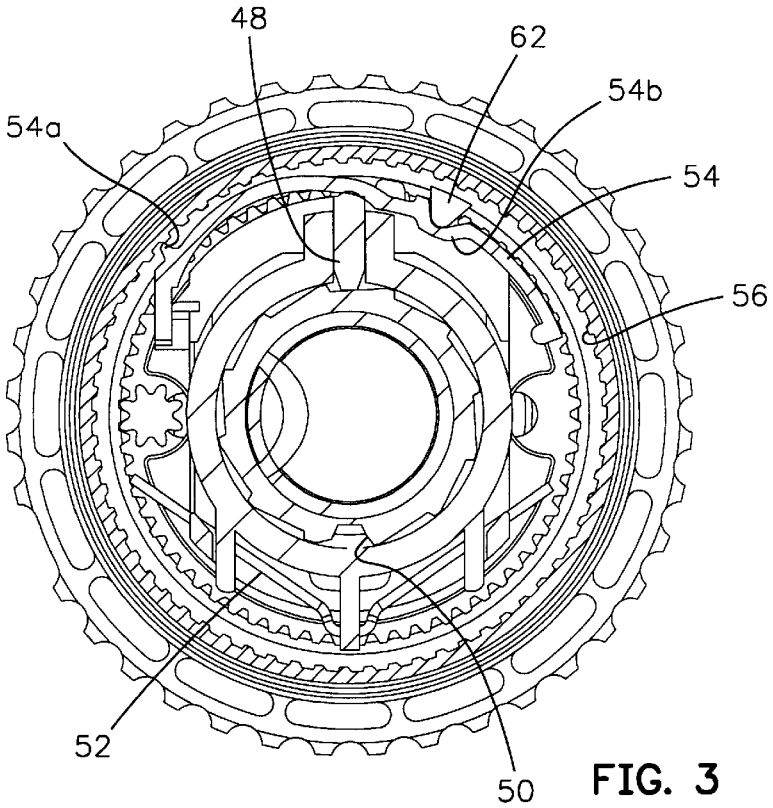
FIG. 3 is view similar to FIG. 2 showing the throttling valve in its closed position.
Figure 4:
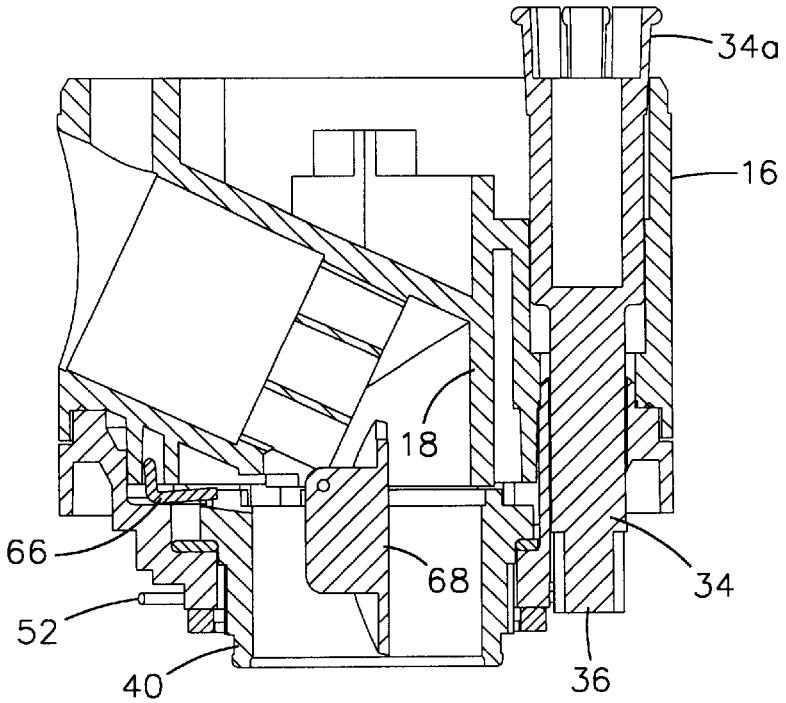
FIG. 4 is an enlarged vertical sectional view of the head and nozzle of the sprinkler of FIG. 1 showing its throttling valve in its open position.
Figure 5:
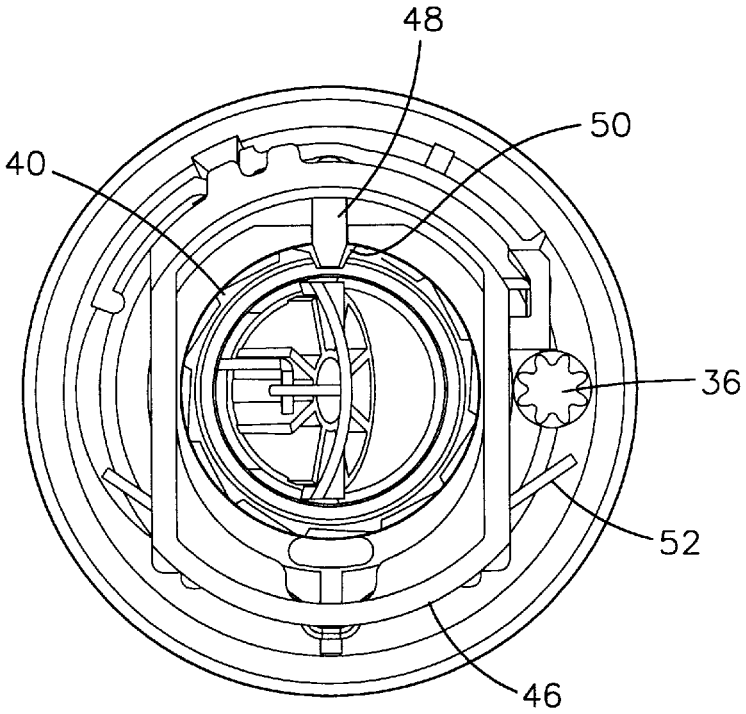
FIG. 5 is an enlarged bottom elevation view of the combination memory arc mechanism and throttling valve mechanism of the sprinkler of FIG. 1.
Figure 6:
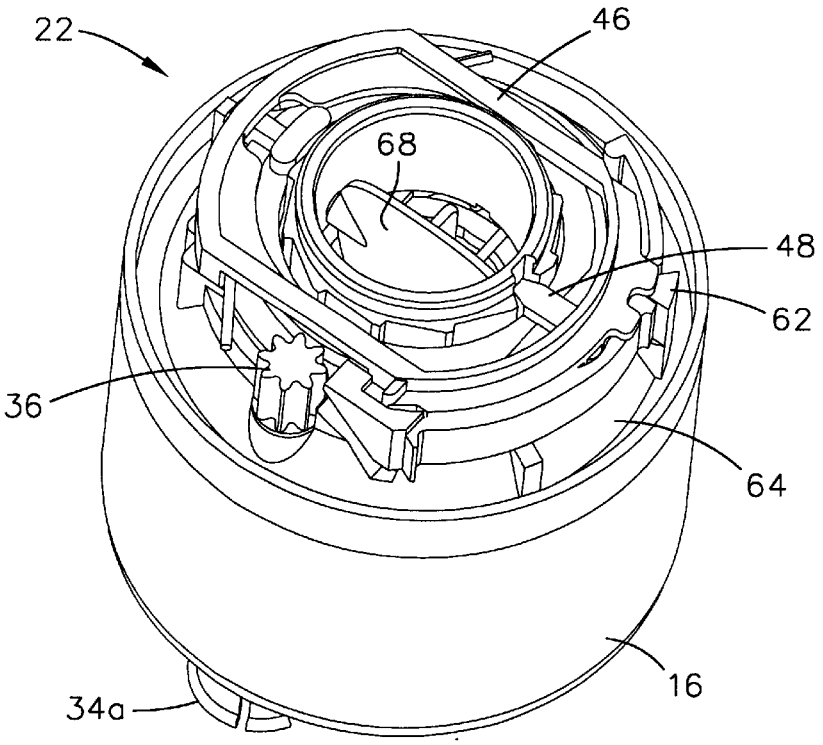
FIG. 6 is an enlarged perspective view taken from the underside of the combination memory arc mechanism and throttling valve of the sprinkler of FIG. 1.

The clutch assembly 22 includes a clutch head 40 (FIGS. 2 and 3) whose lower end is fixedly secured by spin welding, sonic welding or other suitable permanent attachment method to the upper end of the central drive shaft 20 as shown in FIG. 1. The lower end of the clutch head 40 is rotatable within a cylindrical collar 42 (FIG. 2) formed at the lower end of the nozzle 18. A plurality of equally circumferentially spaced identical saw tooth ramps 44 extend radially outwardly from the lower end of the clutch head 40. Referring to FIGS. 5 and 6, a generally rectangular clutch frame 46 straddles the clutch head 40 and includes an inwardly directed driver dog 48

A home key 50 (FIGS. 2, 3, 5 and 11) in the form of an outwardly opening slot or valley is formed in the clutch head 40 between an adjacent pair of the saw tooth ramps 44. The home key 50 is shaped to receive the tapered inner end of the dog 48. The nozzle 18 and clutch assembly 22 are kept in alignment by a metal torsion spring 52 (FIGS. 2 and 3) that normally holds the driver dog 48 in the home key 50. If a vandal twists the riser, or holds it against rotation while the sprinkler is ON, the driver dog 48 is forced out of the home key 50 by lateral shifting movement of the clutch frame 46. The sharp outer end 54a of a resilient curved brake arm 54 is then moved by the clutch frame 46 into engagement with the serrated inner surface of a friction ring 56 forming an upper portion of the riser 12. A smooth lower shoulder portion 56*a* of the friction ring 56 is fixedly connected by spin welding, sonic welding or other suitable permanent attachment method to the main portion 60 of the riser 12 as best seen in FIG. 1.

The brake arm 54 (FIGS. 2 and 3) has an intermediate segment 54*b* that is shaped to receive a V-shaped post 62 that extends downwardly from a nozzle support structure 64 (FIG. 6) forming part of the head 16. This fixes the position of the brake arm 54 relative to the head 16. When the outer end 54*a* of the brake arm 54 engages the serrated inner surface of the friction ring 56, the head 16 and the nozzle 18 contained therein are held stationary while the turbine 24 and gear reduction 26 rotate the central drive shaft 20 in a first direction (counter-clockwise in FIGS. 2 and 3). The clutch assembly 22 will slip in this first mode because of the interaction of the drive dog 48 and the gradually sloped faces of the saw tooth ramps 44 on the clutch head 40. Eventually the reversing mechanism of the sprinkler 10 will reverse itself and begin to rotate the central shaft 20 in a second opposite direction (clockwise in FIGS. 2 and 3). In this second mode the head 16 and nozzle 18 will rotate in the first direction because the steeply sloped face of one of the saw tooth ramps 44 on the clutch head 40 will push on the driver dog 48. The drive force of the clutch head 40 will cause the outer sharp end 54*a* of the brake arm 54 to slide over the serrations of the friction ring 56. Eventually the reversing mechanism of the sprinkler 10 will reverse itself again, and again rotate the central drive shaft 20 in the first direction again (counter-clockwise in FIGS. 2 and 3) and the head 16 and nozzle 18 will once again be held stationary for a time because the friction of the sharp end 54*a* of the brake arm 54 will be enough to resist the force of the driver dog 48 sliding over the gradually sloping ramps 44 of the clutch head 40. In this fashion the head 16 and the nozzle 18 will "walk" or progressively move back to their proper rotational positions within the pre-set arc limits in a succession of clockwise movements in FIGS. 2 and 3.

The dog driver 48 will drop back into the key 50 in the clutch head 40 under the restoring force of the torsion spring 52 when the head 16 and nozzle 18 reach their predetermined proper rotational positions within the pre-set arc. At this time the clutch assembly 22 re-engages the head 16 and central drive shaft 20 on a standard operational basis unless and until a vandal once again forces the head beyond its arc limits. The clutch assembly 22 thus provides a memory arc mechanism which is completely separate from the reversing and arc adjustment mechanisms. If any part of the clutch assembly 22 should freeze in position or lose flexibility, the head 16 will most likely stay locked to the central drive shaft 20. Under such circumstances normal oscillation of the water stream within the arc limits will not be disturbed.

Figure 7:
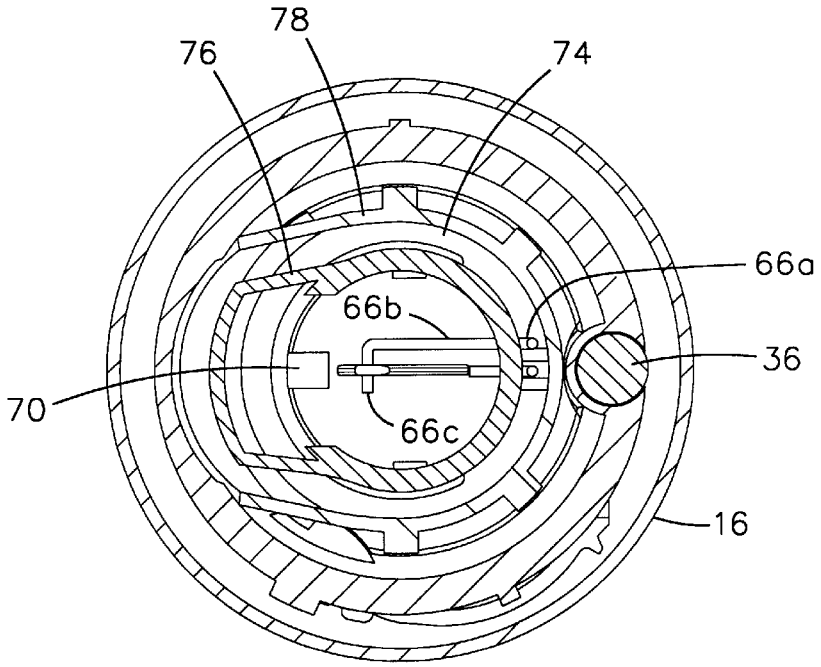
FIG. 7 is a cross-sectional view of the memory arc and throttling valve mechanisms taken along line B—B of FIG. 8.
Figure 8:
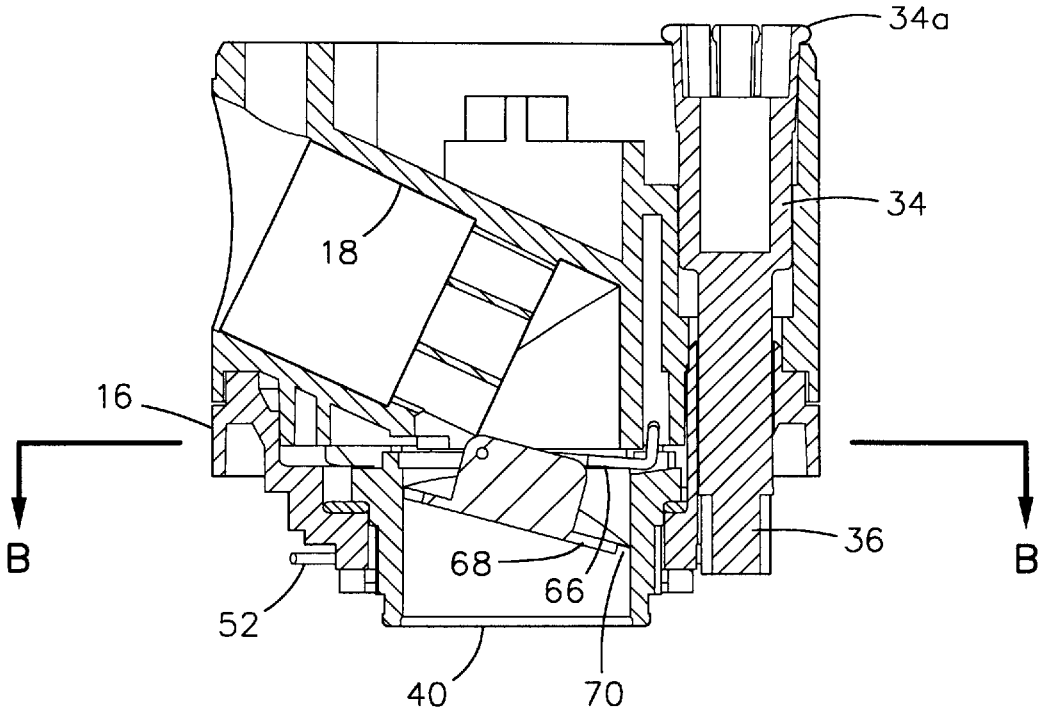
FIG. 8 is an enlarged vertical sectional view of the head and nozzle of the sprinkler of FIG. 1 similar to FIG. 4 showing its throttling valve in its closed position.
Figure 9:
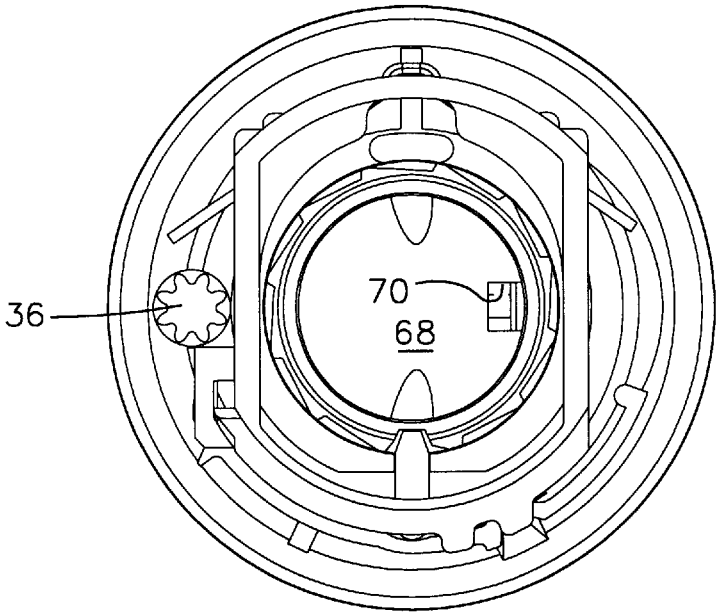
FIG. 9 is an enlarged elevation view of the underside of the combination memory arc mechanism and throttling valve mechanism similar to FIG. 5 in which the dog of the clutch head assembly has moved out of its key slot in the clutch head.
Figure 10:
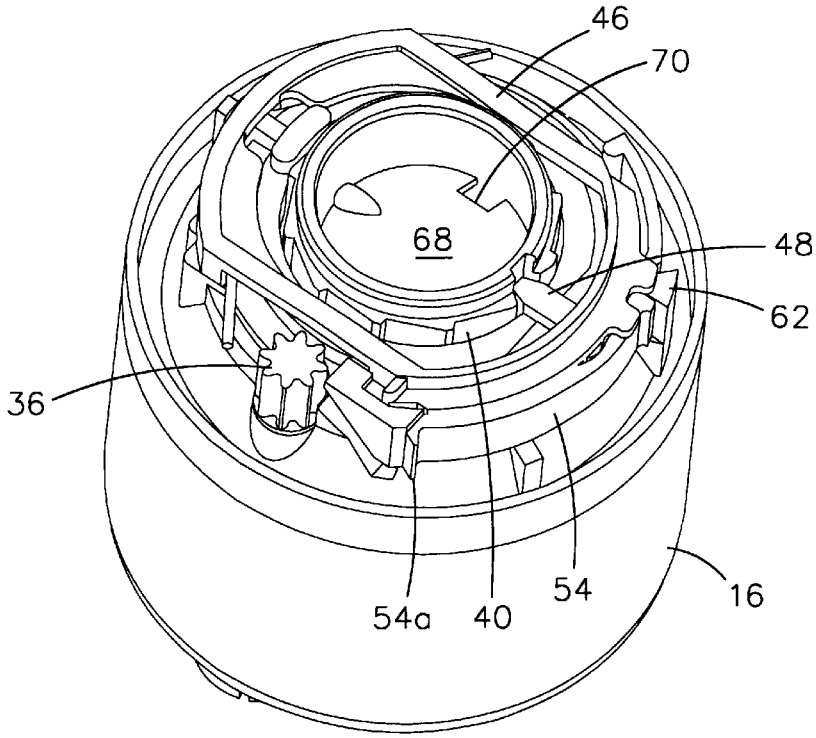
FIG. 10 is an enlarged perspective view taken from the underside of the combination memory arc and throttling valve mechanisms similar to FIG. 6 in which the throttling valve is shown in its closed position.

As soon as the driver dog 48 is forced out of its home key 50 the relative motion of the clutch head 40 and the head 16 is transferred through a metal L-shaped linkage arm 66 (FIG. 7) to swing a convex and elliptical shaped valve member 68 pivotally mounted in the central opening of the clutch head 40 to its closed position shown in FIGS. 3, 8, 9 and 10. This substantially reduces the flow of water through the central drive shaft 20 and the nozzle 18. The valve member 68 is provided with a small bypass opening 70 (FIG. 10) that permits a small amount of water to flow through the central drive shaft 20 and the nozzle 18 to ensure that the turbine 24 continues to rotate the shaft 20. If this were not the case, then the head 16 would not walk its way back to a position within it predefined arc limits. However, when the nozzle 18 is forced out of arc, the stream of water from the nozzle 18 is greatly reduced in its reach and in its volume so that adjacent walkways and roadways are not watered.

Once the driver dog 48 moves back into the home key 50 the linkage arm 66 swings the valve member 68 back to its fully open position illustrated in FIGS. 1, 2, 4–6 and 11. The stream of water ejected from the nozzle returns to normal inclined trajectory and full flow rate so that the zone or landscape area which the sprinkler has been installed to cover is once again watered with a uniform precipitation rate as desired.

The memory arc feature of the sprinkler 10 will actually engage at any point outside the home key or pre-set location of the clutch head 40 relative to the drive shaft 20 and the head 16 will be returned to this home key position. Turning or holding the head 16 inside the preset end limits will therefore still activate the memory arc and throttling valve mechanisms. The head 16 is not damaged and the valve member 68 is still operated regardless of any reference to the pre-set end limits.

The fact that the sprinkler 10 nearly shuts off the water stream when the riser 12 is forced out of arc by a vandal makes it less attractive for a vandal to grab and hold or twist the riser 12 in the first place. In addition, if the memory arc portion of my sprinkler should fail, the basic functionality of the sprinkler itself will not be adversely affected, i.e. rotation of the water stream between the user-programmed arc limits. Thus if the memory arc mechanism fails without the riser being twisted out of arc limits, the sprinkler head 16 will continue to rotate angularly through the desired sector. If the memory arc feature of my rotary sprinkler 10 breaks when the twists the head 16 out of its arc limits, landscape maintenance personnel can still twist the head 16 back within the pre-set arc limits and the head 16 will continue to oscillate between these limits.

It may be desirable to provide the user with the option of completely closing the passage in the central drive shaft 20. This closure may be complete and may be accomplished with a structure such as that which is disclosed in my U.S. Pat. No. 5,762,270 granted Jun. 9, 1998, and entitled SPRINKLER UNIT WITH FLOW STOP, the entire disclosure of which is hereby incorporated by reference. In such a case, any orifice or bypass opening in the valve member 68 may be eliminated. The sprinkler 10 would partially close the valve member 68 automatically when forced out of arc, but would still allow some flow of water if the sprinkler 10 had a memory arc mechanism that needed to be driven. The closing of the valve member 68 manually would provide complete closure of the passage in the drive shaft 20 and thus a complete cut off of the water stream from the nozzle 18.

Those skilled in the art of sprinkler design will recognize from my description that it is desirable to substantially reduce the flow of water from the sprinkler 10 when the nozzle 18 is outside its end limits. This will, for example, prevent water from shooting onto a highway in locations where sprinklers are used to irrigate roadside vegetation or into open windows of a residence. Whereas a conventional pop-up sprinkler might shoot a stream of water over fifty feet under normal conditions, with my invention the stream is preferably reduced to about two to three feet or less. This represents over a ninety percent reduction. However in rotary turbine driven pop-up sprinklers of the type illustrated and described herein, a minimum flow of water through the nozzle is still needed to ensure that the nozzle 18 will be rotated back to a position within its arc limits. By way of example, a minimum desirable flow rate might be four gallons per minute.

Figure 11:
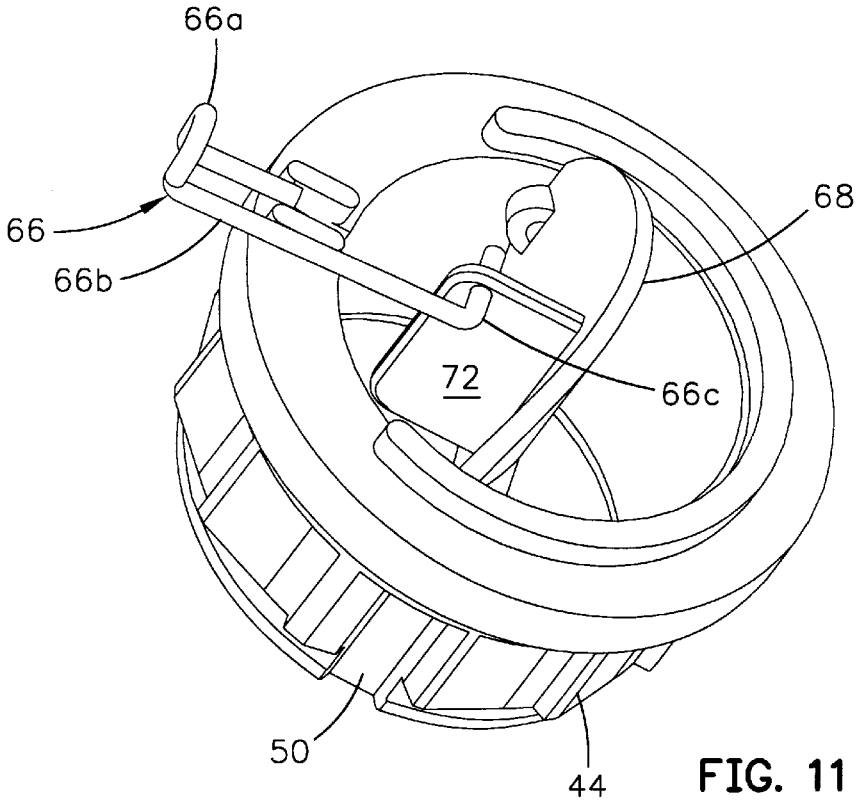
FIG. 11 is an enlarged perspective view of the underside of the clutch head showing the throttling valve member pivotally mounted therein.
Figure 12:
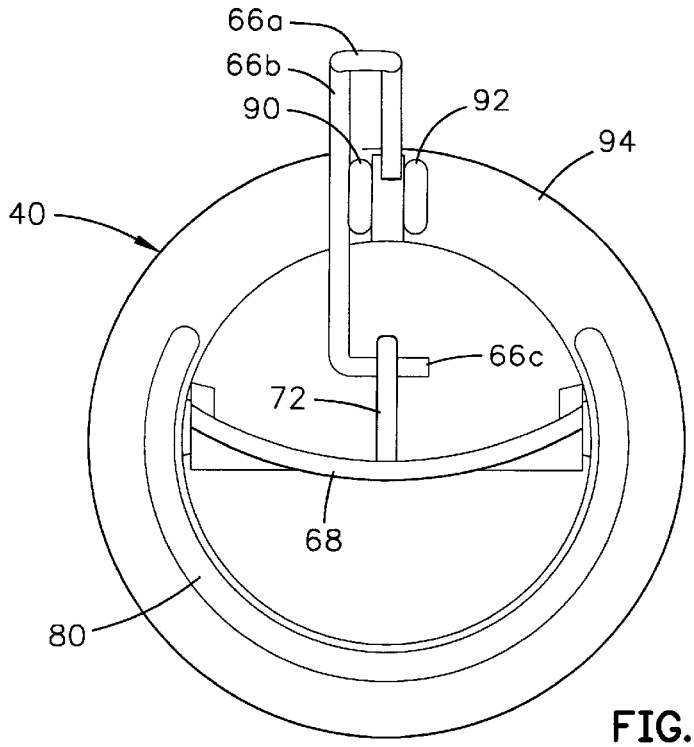
FIG. 12 is an enlarged top plan view of the clutch head showing the throttling valve member pivotally mounted therein.
Figure 13:
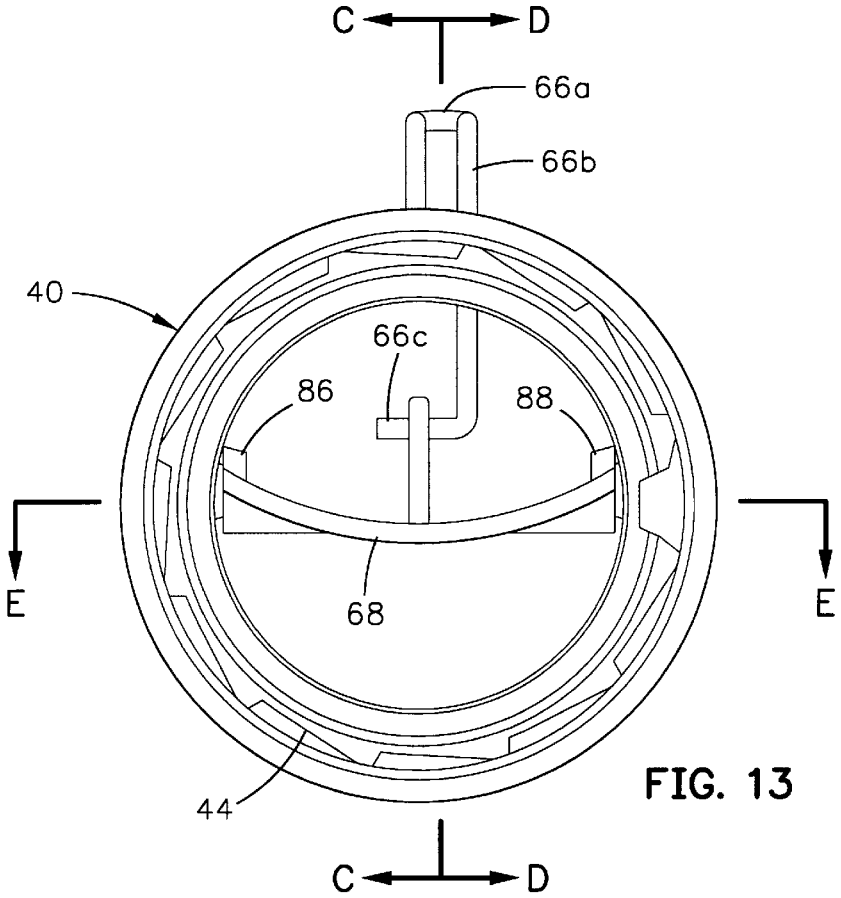
FIG. 13 is an enlarged bottom plan view of the clutch head showing the throttling valve member pivotally mounted therein.
Figure 14:
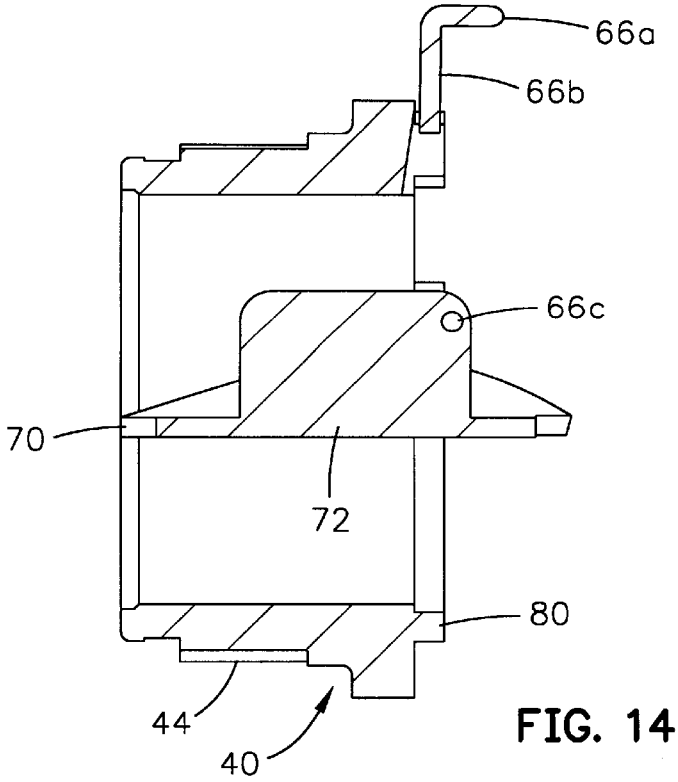
FIG. 14 is an enlarged vertical sectional view of the clutch head taken along line C—C of FIG. 13 showing the throttling valve member pivotally mounted therein.
Figure 15:
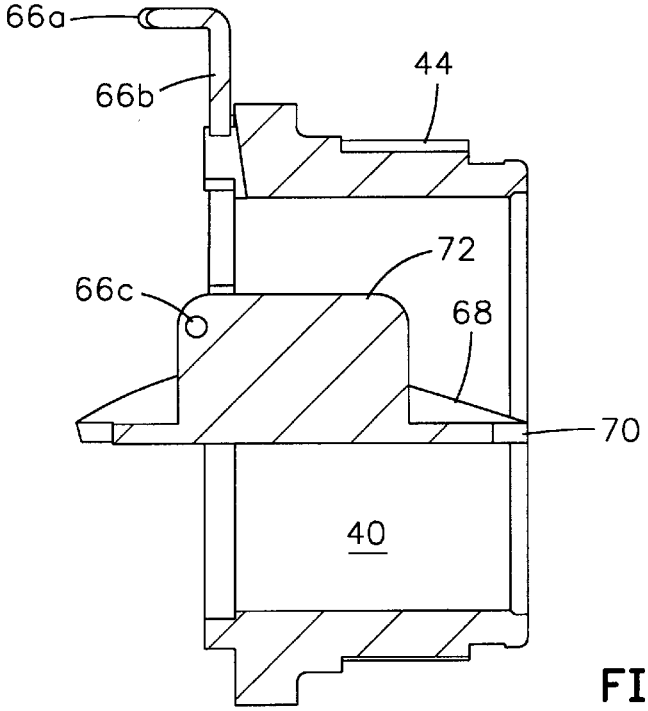
FIG. 15 is an enlarged vertical sectional view of the clutch head taken along line D—D of FIG. 13 showing the throttling valve member pivotally mounted therein.
Figure 16:
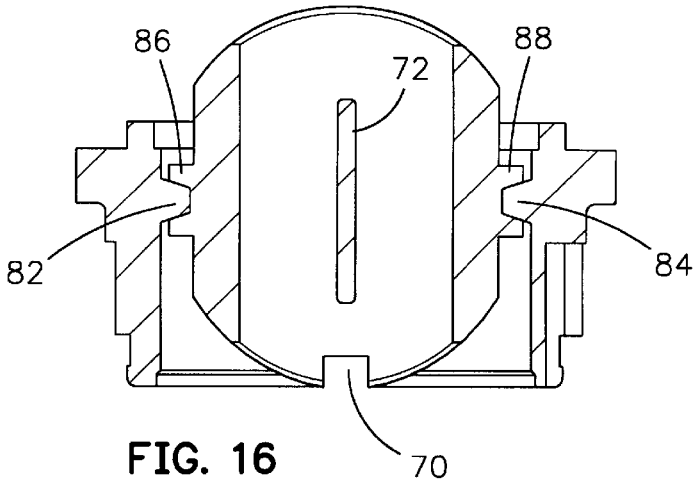
FIG. 16 is an enlarged vertical sectional view of the clutch head taken along line E—E of FIG. 13 showing the throttling valve member pivotally mounted therein.

Referring to FIG. 11, the L-shaped linkage arm 66 has an outer rounded end 66*a* that is bent at a right angle with respect to an intermediate segment 66*b* thereof. An inner segment 66*c* of the linkage arm 66 extends through a hole in a flange 72 that extends orthogonally from the convex body portion of the valve member 68. The outer end 66*a* of the linkage arm 66 rides in a pear-shaped groove 74 (FIG. 7) formed by complementary inner and outer walls 76 and 78 molded into the base of the nozzle 18. As the clutch head 40 spins relative to the nozzle 18 the outer end 66*a* of the linkage arm 66 glides along the length of the groove 74 which forms a sort of guide track. The pear shape of the groove 74 is dimensioned and oriented to form a cam so that the linkage arm 66 moves laterally to thereby swing the valve member 68 to its fully open position when the nozzle 18 is pointed within the pre-set arc limits. When the head 16 is forced outside its arc limits the linkage arm 66 swings the valve member 68 to its closed position where it stays until the head 16 and nozzle 18 walk back to positions within the end limits. At that time the linkage arm 66 swings the valve member 68 back to its open position. The combination of the linkage arm 66, pivoting valve member 68, clutch head 40 and groove 74 in the base of the nozzle 18 provide a throttling valve mechanism. This throttling valve mechanism automatically reduces the stream of water ejected from the nozzle 18 when the rotational position of the nozzle 18 is forced outside its pre-set end limits. This same throttling valve mechanism returns the water stream to its full force and trajectory once the memory arc mechanism returns the head 16 and the nozzle 18 back to their proper rotational positions within the pre-set limits of the preprogrammed arc.

FIGS. 11–16 illustrate details of the valve member 68 and the manner in which it is pivotally mounted inside the central opening of the clutch head 40. The upper end of the clutch head 40 is molded with an arcuate guide surface 80 (FIG. 11) that rides inside a complementary surface in the underside of the nozzle 18. Pivot pins 82 and 84 (FIG. 16) molded on the inner cylindrical wall of the clutch head 40 are received in corresponding cylindrical collars 86 and 88 on opposite sides of the valve member 68. This arrangement supports the valve member 68 for pivotal movement within the cylindrical central opening of the clutch head 40. A pair of ridges 90 and 92 (FIG. 12) molded on the flat horizontal end wall 94 of the clutch head 40 guide and retain a fourth segment 66d of the linkage arm 66.

Figure 17:
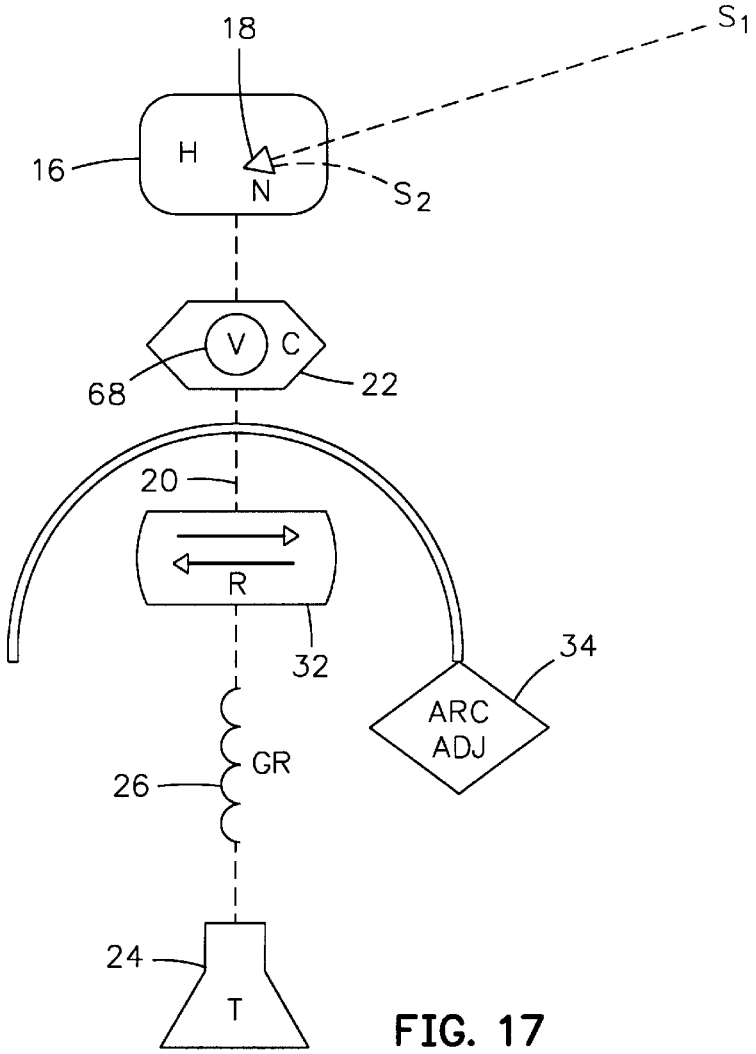
FIG. 17 is a diagrammatic illustration of the principal functional components of the sprinkler of FIG. 1.
Figure 18:
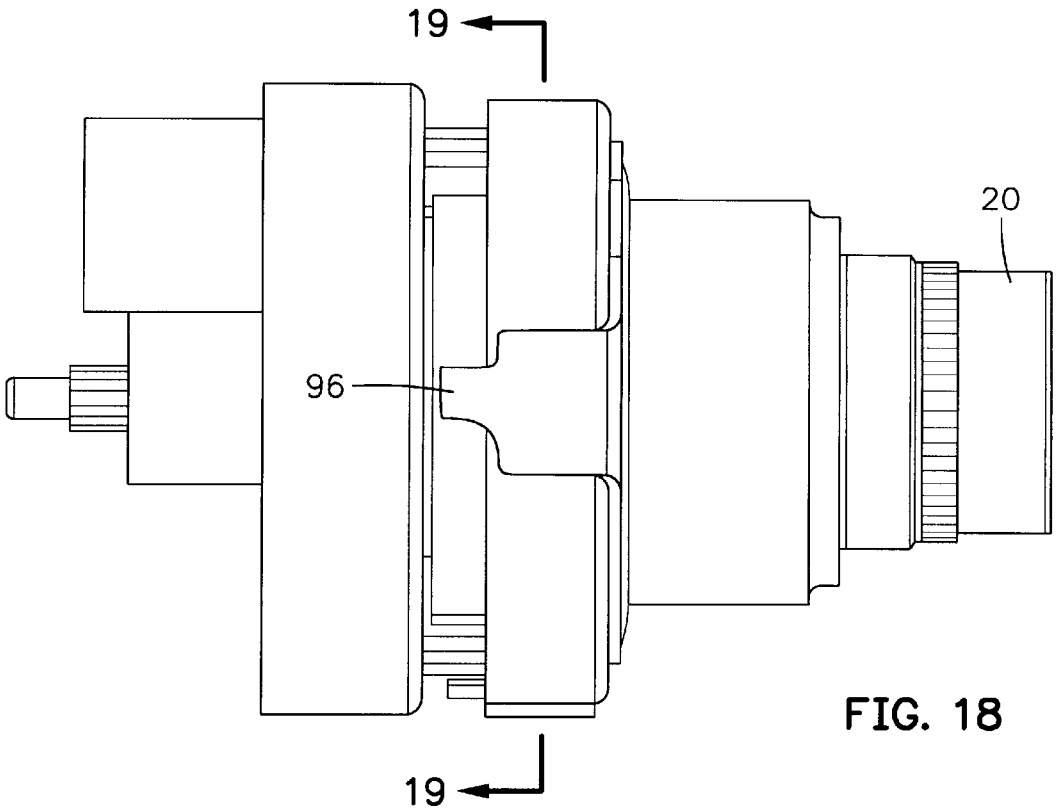
FIG. 18 is an enlarged side elevation view of a portion of the sprinkler of FIG. 1 showing details of its mechanism for pre-setting one of its end limits of rotation of its nozzle containing head.
Figure 19:
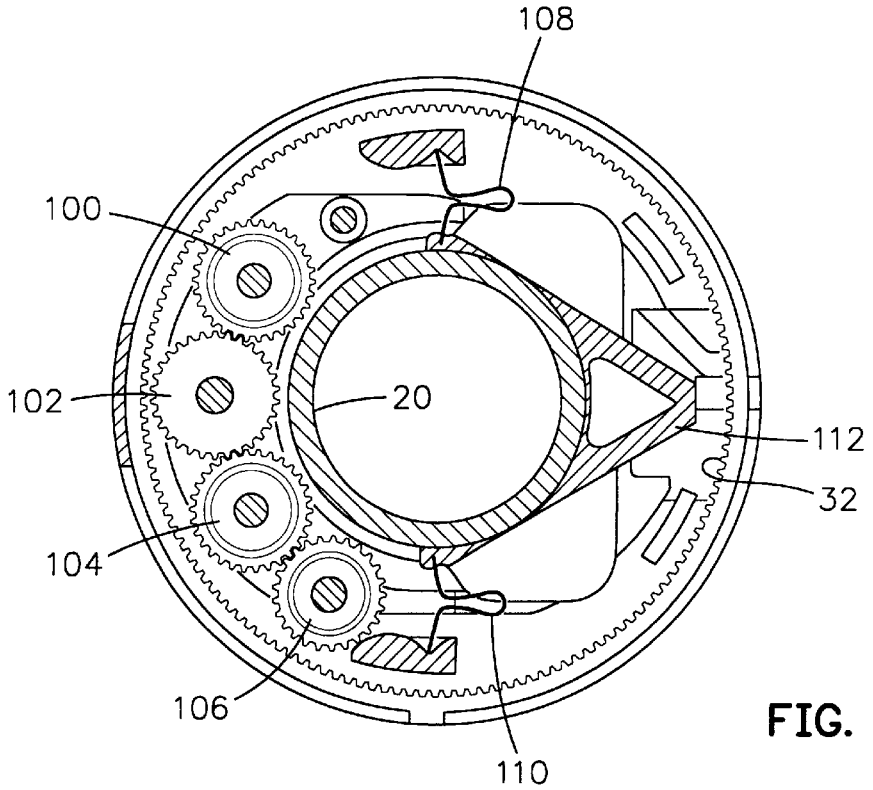
FIG. 19 is a cross-sectional view taken along line F—F showing details of the head reversing mechanism of the sprinkler of FIG. 2.
Figure 20:
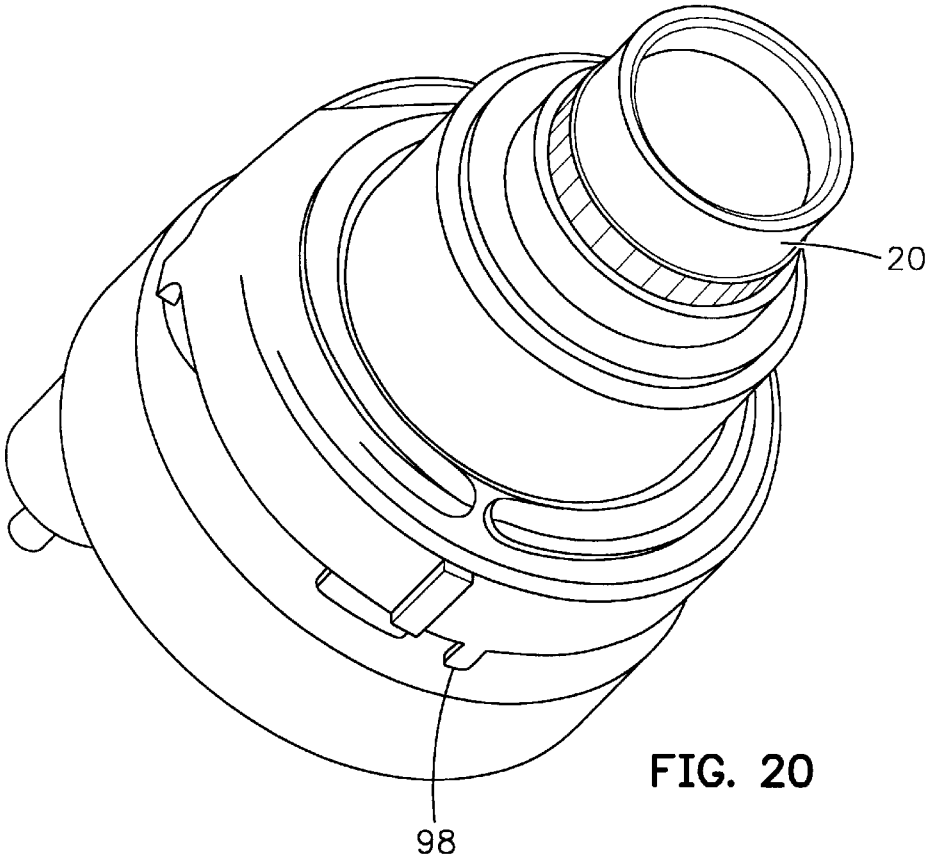
FIG. 20 is a perspective view the portion of the sprinkler illustrated in FIG. 18 showing further details of its mechanism for pre-setting one of its end limits of rotation of its nozzle containing head.
Figure 21:
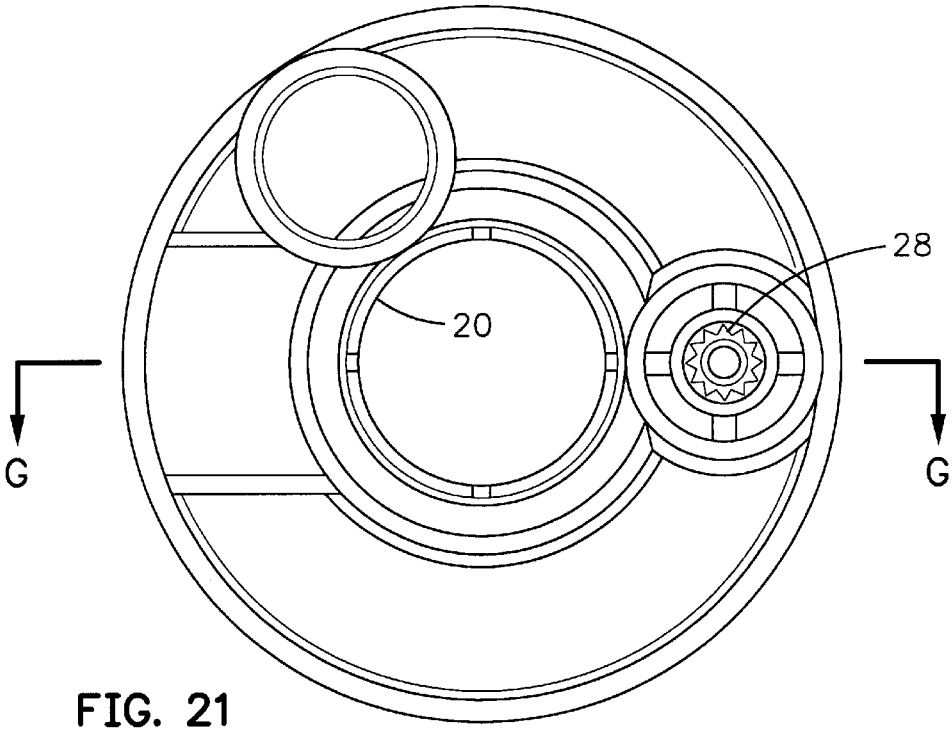
FIG. 21 is a bottom plan view of the portion of the sprinkler illustrated in FIG. 18 taken from the left side of FIG.18.

FIG. 17 is a diagrammatic illustration of the principal functional components of the sprinkler 10 of FIG. 1. The turbine 24 labeled "T" drives the gear reduction 26 labeled "GR". The gear reduction transfers its rotary motion through the central drive shaft 20 to oscillate the head 16 also labeled "H" through the clutch assembly 22, labeled "C". The rotary motion of the central drive shaft 20 is controlled and limited by the reversing mechanism labeled "R", including the bull gear 32, and the arc adjustment mechanism labeled "ARC AD J", including the collet 34. A normal stream S1 of water is ejected from the nozzle 18 labeled "N" which travels a substantial distance to cover the adjacent landscaping. When the head H is twisted forced out of arc, the throttling valve mechanism, labeled "V" substantially reduces the flow of water so that a secondary stream S2 of water is ejected from the nozzle which has considerably less range and/or volume than the normal stream SI of water. The secondary stream S2 of water continues to be ejected so long as the nozzle N is in a rotational position outside the pre-set arc limits. The clutch assembly C engages and disengages the head H with the drive shaft 20 until the head H and the nozzle N return to rotational positions within the pre-set arc limits. At that time, normal oscillation of the head H and nozzle N between the pre-set arc limits resumes. At the same time, the valve V re-opens so that the normal stream of water S1 is once again ejected from the nozzle N.

Figure 22:
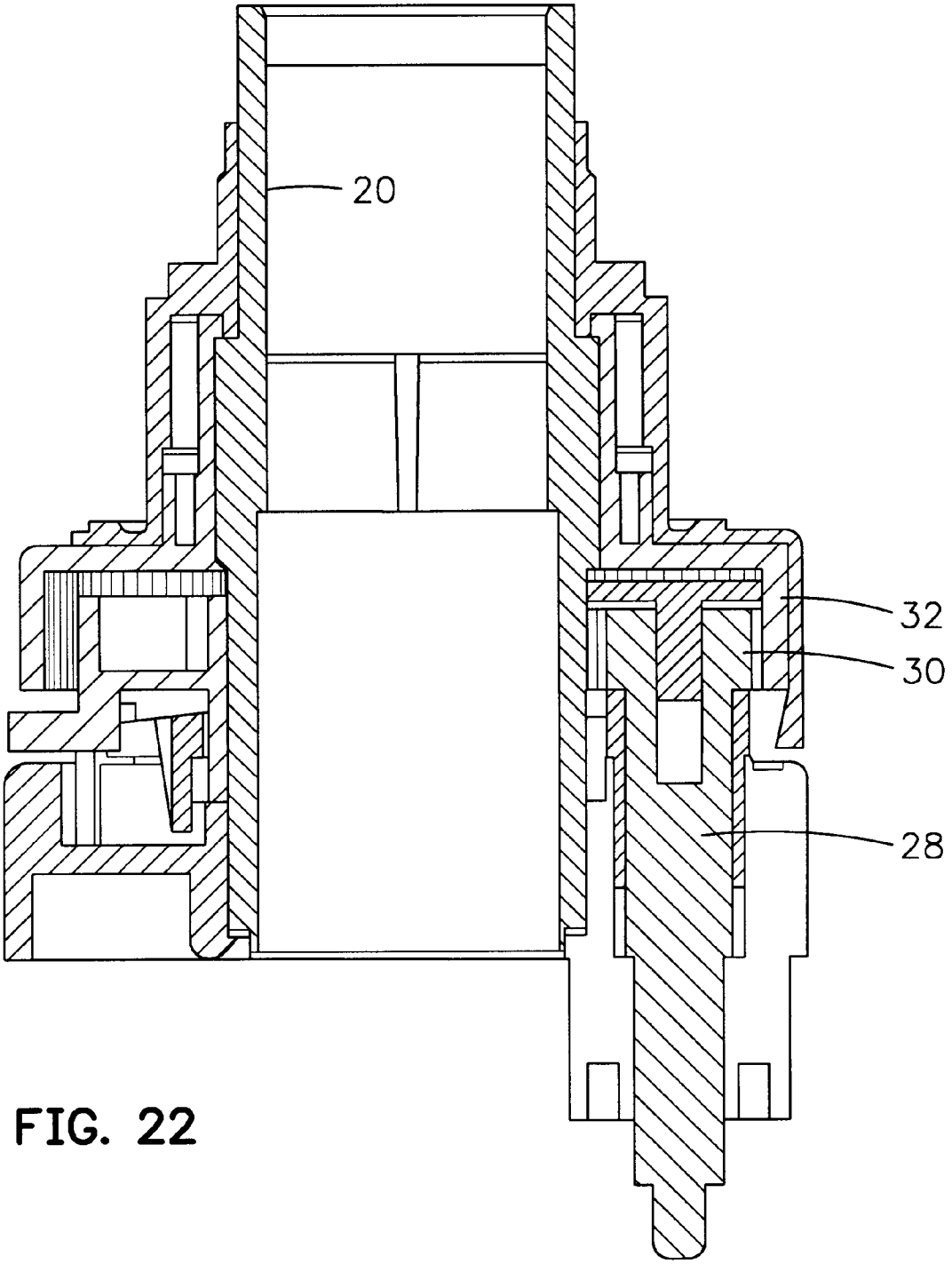
FIG. 22 is a vertical sectional view of the portion of the sprinkler illustrated in FIG. 21 taken along line G—G of FIG. 21.

FIGS. 18–21 illustrate details of the mechanisms of the sprinkler of 10 of FIG. 1 which permit the pre-setting of one of the pair of end limits of rotation, as well as details of the head reversing mechanism. The rotational position of the end limit 96 (FIG. 18) is adjustable by twisting a tool inside of the collet 34. The other end limit 98 (FIG. 20) is fixed. The head reversing mechanism includes a train of four gears 100, 102, 104 and 106 (FIG. 19) that are shiftable to engage the toothed inner surface of the bull gear 32 via over-center springs 108 and 110 and cam 112. The locations of the drive shaft 28, pinion gear 30 and bull gear 32 are further illustrated in FIGS. 21 and 22.

I have not described all of the details of my sprinkler 10 illustrated in FIG. 1 as such details will be apparent from the drawing figures taken collectively, in light of my discussion and my reference to other patents. The configuration of the various parts illustrated herein could be varied as necessary to meet the specific design parameters of a particular application. I have provided a sprinkler with an improved memory arc that is removed from close association with the arc adjustment and reversal mechanisms. My memory arc design can be considered to be a form of "mechanical fuse" that is placed between the head and the arc adjustment and reversal mechanisms. As such, my memory arc mechanism, illustrated in its preferred embodiment as the clutch assembly 22, can be incorporated into a wide variety of existing adjustable arc rotary sprinkler designs without compromising the integrity of its core oscillating water stream functionality. This permits existing rotary arc adjustable sprinklers to be manufactured with a memory arc capability without having to make new tooling for injection molding of the basis parts of the arc adjustable rotor.

My throttling valve mechanism provides the unique advantage of being able to minimize the unwanted spray of water in areas outside the pre-programmed arc. Because my memory arc mechanism is situated remote from the arc adjustment and reversing mechanisms there is sufficient room to combine the memory arc and throttling valve f unctions. This provides my sprinkler with the unique advantage of not only returning the nozzle to oscillation within its preset arc limits, but also minimizing the reach and/or volume of water in the stream ejected from the nozzle so long as the nozzle is pointed out-of-arc.

Whereas a preferred embodiment of my memory arc sprinkler has been described in detail, it will be understood that modifications and adaptations thereof will occur to those skilled in the art. For example, the sprinkler need not be of the pop-up type and may instead have a single fixed cylindrical housing. My memory arc design can be used without the throttling valve, and will still achieve certain benefits regarding operational durability since a failure of the memory arc mechanism will not prevent the sprinkler head from rotating between its pre-set end limits. My throttling valve mechanism can be widely varied to accommodate the configuration of other memory arc designs, such as those of U.S. Pat. Nos. 4,625,914 and 4,901,92, By using the throttling valve mechanism, the reversing mechanism could be eliminated and the head could rotate continuously in a uni-directional manner with the water stream being closed down during the time that the nozzle is pointing outside the pre-set arc limits. Therefore, the protection afforded my invention should only be limited in accordance with the scope of the following claims.

I claim:

1. A sprinkler, comprising:

a housing having an outlet end;

a head including a nozzle for ejecting a stream of water;

means for mounting the head at the outlet end of the housing for angular rotation about a vertical axis;

means mounted in the housing for driving the head about the axis;

means mounted in the housing for pre-setting at least one of a pair of end limits of rotation of the head;

means for causing the rotation of the head to reverse a direction of rotation thereof when a rotational position of the head reaches each of the end limits so that the stream of water will travel through a predefined angular sector; and memory arc means separate from the reversing means for causing the head to return to rotation between the ends limits after the head has been forced outside the end limits.

2. The sprinkler according to claim 1 and further comprising valve means mounted in the housing for reducing the flow of water from the nozzle while the rotational position of the head is outside the end limits.

3. The sprinkler according to claim 1 wherein the means for mounting the head at the outlet end of the housing for angular rotation about a vertical axis includes a vertically reciprocable riser.

4. The sprinkler according to claim 1 wherein the memory arc means includes a clutch assembly for selectively connecting and disconnecting the head and the head driving means.

5. The sprinkler according to claim 2 wherein the valve means includes a valve member and means for pivotally mounting the valve member inside a passage that delivers water to the nozzle.

6. The sprinkler according to claim 5 wherein the valve means further includes a linkage arm connecting the valve member with a portion of the head for moving the valve member between open and closed positions.

7. The sprinkler according to claim 4 wherein the clutch assembly includes a clutch head and a moveable driver dog that moves into and out of engagement with a home key formed in the clutch head.

8. The sprinkler according to claim 1 wherein the memory arc means includes a clutch assembly that slips in a first direction and rotates the head in a second direction in a succession of movements until the head returns to rotation between the ends limits.

9. The sprinkler according to claim 5 wherein the valve member has a bypass opening formed therein.

10. The sprinkler according to claim 1 wherein the head mounting means includes a central hollow drive shaft.

11. A sprinkler, comprising:

a housing having an outlet end;

a head mounted at the outlet end of the housing and including a nozzle for ejecting a stream of water;

a passage extending through the housing for delivering water to the nozzle;

a drive shaft mounted in the housing for angular rotation about a substantially vertical axis, clutch assembly coupling the head and the drive shaft;

a drive mechanism powered by water flowing through the housing for rotating the drive shaft about the vertical axis;

an arc adjustment mechanism mounted in the housing for pre-setting at least one of two end limits of angular movement of the head;

a reversing mechanism mounted in the housing that reverses a direction of rotation of the head when the drive shaft reaches each of the end limits so that the stream of water will oscillate through a predetermined arc; and the clutch assembly configured to disengage the head and the drive shaft when the head is manually twisted or is held against rotation to cause rotation of the head to a first position, and to thereafter automatically engage the head and the drive shaft to rotate the head to a second position so that the stream of water will once again oscillate through the predetermined arc.

12. The sprinkler according to claim 11 and further comprising a throttling valve mechanism mounted in the housing and actuated by the clutch assembly for reducing the flow of water from the nozzle when the rotational position of the head is outside the pre-set end limits.

13. The sprinkler according to claim 11 and further comprising a vertically reciprocable riser for enclosing and supporting the drive mechanism, arc adjustment mechanism and reversing mechanism.

14. The sprinkler according to claim 12 wherein the throttling valve includes a pivoting valve member.

15. The sprinkler according to claim 11 wherein the clutch assembly includes a clutch head and a moveable driver dog that moves into and out of engagement with a home key formed in the clutch head.

16. The sprinkler according to claim 11 wherein the clutch assembly slips in a first direction and rotates the head in a second direction in a succession of movements until the head returns to rotation between the ends limits.

17. The sprinkler according to claim 14 wherein the throttling valve mechanism further includes a linkage arm connecting the valve member with a portion of the head for moving the valve member between open and closed positions.

18. The sprinkler according to claim 17 and further comprising a groove formed in the head for receiving a segment of the linkage arm to provide for lateral movement thereof.

19. The sprinkler according to claim 11 wherein the arc adjustment mechanism includes a collet accessible through the head of the sprinkler with a tool for pre-setting at least one of two end limits of angular movement of the head.

20. A sprinkler, comprising:

a housing having an outlet end;

a nozzle mounted at the outlet end of the housing for ejecting a stream of water in an outward direction from the housing;

a passage extending through the housing for delivering water to the nozzle;

a drive mechanism mounted in the housing and coupled to the nozzle for rotating the nozzle about an axis;

an arc adjustment mechanism mounted in the housing for pre-setting at least one of two end limits of angular movement of the nozzle;

a reversing mechanism mounted in the housing that reverses a direction of rotation of the nozzle when a rotational position of the nozzle reaches each of the end limits so that normally the stream of water will oscillate through a predetermined arc; and a throttling valve mechanism mounted in the housing for automatically reducing the stream of water ejected from the nozzle when the rotational position of the nozzle is forced outside the end limits.

* * * * *

UNITED STATES PATENT AND TRADEMARK OFFICE

CERTIFICATE OF CORRECTION

PATENT NO. : 6,050,502
DATED : April 18, 2000
INVENTOR(S) : Mike Clark

It is certified that error appears in the above-identified patent and that said Letters Patent is hereby corrected as shown below:

Column 10,
Line 55, change "," to --;--;
Line 56, before "clutch assembly" insert --a--;

Signed and Sealed this

Thirty-first Day of July, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,050,502
DATED : April 18, 2000
INVENTOR(S) : Mike Clark

It is certified that error appears in the above-identified patent and that said Letters Patent is hereby corrected as shown below:

Claim 1, column 10,
Line 11, change "ends" to -- end --.

Claim 11, column 11,
Line 1, before "configured" insert -- being --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*